US011241052B2

(12) United States Patent
Jerusik

(10) Patent No.: US 11,241,052 B2
(45) Date of Patent: Feb. 8, 2022

(54) PARTIAL-HAND GLOVE

(71) Applicant: Lori Jerusik, Chicopee, MA (US)

(72) Inventor: Lori Jerusik, Chicopee, MA (US)

( * ) Notice: Subject to any disclaimer, the term of this patent is extended or adjusted under 35 U.S.C. 154(b) by 306 days.

(21) Appl. No.: 16/441,558

(22) Filed: Jun. 14, 2019

(65) Prior Publication Data

US 2020/0390170 A1 Dec. 17, 2020

(51) Int. Cl.
*A41D 19/00* (2006.01)

(52) U.S. Cl.
CPC .... *A41D 19/0003* (2013.01); *A41D 2600/106* (2013.01); *A41D 2600/20* (2013.01)

(58) Field of Classification Search
CPC ..... A41D 19/0003; A41D 2600/106; A41D 2600/20
See application file for complete search history.

(56) References Cited

U.S. PATENT DOCUMENTS 1,149,139 A * 8/1915 Heagle ..... A41D 19/00 2/159
2,084,428 A * 6/1937 Bush ..... A63B 71/146 2/159
3,606,614 A * 9/1971 NamDimitroff ..... A63B 71/148 2/159
3,736,926 A * 6/1973 Irby ..... A61F 5/37 128/879
4,408,358 A 10/1983 Swan
4,519,097 A * 5/1985 Chappell, Jr. ..... A41D 19/015 2/159
4,561,122 A * 12/1985 Stanley ..... A41D 19/015 2/161.1
4,747,163 A * 5/1988 Dzierson ..... A41D 19/01523 2/161.1
4,751,747 A 6/1988 Banks et al.
4,894,866 A * 1/1990 Walker ..... A41D 19/01547 2/159
4,958,384 A * 9/1990 McCrane ..... A41D 19/01582 2/161.6
5,214,799 A * 6/1993 Fabry ..... A41D 19/01523 2/161.6
5,276,922 A * 1/1994 Floyd, Jr. ..... A41D 19/01594 2/160
5,768,711 A * 6/1998 Wissink ..... A41D 19/0034 2/160

(Continued)

FOREIGN PATENT DOCUMENTS

WO WO1997015203 5/1997

*Primary Examiner* — Khaled Annis
(74) *Attorney, Agent, or Firm* — Getz Balich LLC

(57) ABSTRACT

A partial-hand glove includes a first glove portion, a second glove portion, and a base glove portion. The first glove portion is configured to surround a portion of only an index finger of a hand of a user. The outer end of the first glove portion is configured to be spaced from a tip of the index finger. The second glove portion is configured to surround a portion of only a thumb of the hand of the user. The outer end of the second glove portion is configured to be spaced from a tip of the thumb. The base glove portion is connected to the respective inner ends of the first glove portion and the second glove portion. The first glove portion and the base glove portion collectively define an interior side of the glove opposite the second glove portion.

18 Claims, 6 Drawing Sheets

(56) References Cited

U.S. PATENT DOCUMENTS 5,790,980 A * 8/1998 Yewer, Jr. ..... A41D 19/01523 2/161.1
5,802,614 A * 9/1998 Melone, Jr. ..... A41D 19/01582 2/161.1
6,098,200 A * 8/2000 Minkow ..... A41D 19/01523 2/161.1
6,112,331 A * 9/2000 Horn ..... A63B 21/4019 2/163
6,182,293 B1 * 2/2001 Mustin ..... A41D 19/01547 2/161.1
6,687,911 B2 * 2/2004 Fitz ..... A41D 19/0075 2/163
6,745,402 B2 * 6/2004 Caswell ..... A41D 19/01582 2/161.1
6,810,530 B2 11/2004 Bryant, Sr.
7,114,193 B2 10/2006 Winningham
D533,314 S 12/2006 Schiazza
7,380,289 B2 * 6/2008 Kordecki, Jr. ..... A41D 19/0055 2/161.6
D581,100 S * 11/2008 Stalter ..... D29/113
7,735,153 B1 6/2010 Romiti
7,895,671 B2 3/2011 Salomon
D694,960 S 12/2013 Shibahara
8,925,113 B2 * 1/2015 Fricke ..... A63B 71/141 2/16
9,480,291 B2 11/2016 Joffe et al.
9,884,241 B2 2/2018 Ramirez
10,264,875 B2 4/2019 Shaykova
2006/0206981 A1 * 9/2006 Morrow ..... A63B 71/143 2/161.1
2008/0229478 A1 9/2008 Maroun
2009/0025120 A1 1/2009 Vestling
2012/0017350 A1 * 1/2012 McCrane ..... A63B 71/141 2/161.1
2013/0180022 A1 7/2013 Baungartger
2016/0367882 A1 * 12/2016 Ramirez ..... A41D 27/28
2017/0000199 A1 1/2017 Guzman
2017/0127737 A1 5/2017 Perryman

* cited by examiner

PARTIAL-HAND GLOVE

BACKGROUND

1. Technical Field

This disclosure relates generally to gloves, and more particularly, to gloves configured for protection of a portion of a user's hand.

2. Background Information

Performance of physical labor, for example, raking or digging activities associated with general yardwork, can lead to excessive wear on the hands of the worker. For example, repetitive rubbing of the worker's hands against tools or other objects can lead to formation of cuts, abrasions, blisters, sores, etc. on affected portions of the worker's hands. Portions of the hand which may be most susceptible to injury may include, among others, the skin between the worker's thumb and index finger and/or the thenar space of the hand.

Conventional gloves seek to address the above-noted problems by covering most or all of a user's hands. However, this approach has several disadvantages. Covering the user's fingers, particularly the thumb and index finger, negatively impacts the user's finger dexterity and ability to perform fine motor functions. Further, complete envelopment of the hand can result in excessive sweating and heat inside the glove, resulting in discomfort for the user. Said heat and sweating can additionally accelerate the formation of blisters on a user's hand as a result of friction between the glove and the user's skin. In some cases, gloves may include wrist attachments which may lead to further sweating and present additional rubbing surfaces against the user's skin. Wrist attachments may also extend the time required for donning and doffing of the gloves. Finally, conventional gloves may require multiple pieces of material to be assembled together in order to conform to the shape of the user's entire hand, thereby complicating manufacturing of the glove. Accordingly, an improved glove addressing one or more of the above-noted issues would find utility.

SUMMARY

According to an embodiment of the present disclosure, a partial-hand glove includes a first glove portion, a second glove portion, and a base glove portion. The first glove portion is configured to surround a portion of only an index finger of a hand of a user. The first glove portion has an outer end and an inner end opposite the outer end. The outer end of the first glove portion is configured to be spaced from a tip of the index finger. The second glove portion is configured to surround a portion of only a thumb of the hand of the user. The second glove portion has an outer end and an inner end opposite the outer end. The outer end of the second glove portion is configured to be spaced from a tip of the thumb. The base glove portion is connected to the respective inner ends of the first glove portion and the second glove portion. The first glove portion and the base glove portion collectively define an interior side of the glove opposite the second glove portion.

In the alternative or additionally thereto, in the foregoing embodiment, the base glove portion is configured to be disposed between the first glove portion and the wrist of the user.

In the alternative or additionally thereto, in the foregoing embodiment, the base glove portion includes a first section configured to be disposed against a palm of the hand of the user and a second section configured to be disposed against a back of the hand of the user.

In the alternative or additionally thereto, in the foregoing embodiment, the base glove portion is open between the first section and the second section of the base glove portion along the interior side of the glove.

In the alternative or additionally thereto, in the foregoing embodiment, the second section of the base glove portion has a greater area than the first section of the base glove portion.

In the alternative or additionally thereto, in the foregoing embodiment, the base glove portion includes a notch disposed in the interior side of the glove at an interface between the first glove portion and the base glove portion.

In the alternative or additionally thereto, in the foregoing embodiment, the first section of the base glove portion is configured to cover a thenar space of the hand of the user.

In the alternative or additionally thereto, in the foregoing embodiment, the first section of the base glove portion is configured to leave a portion of the palm of the hand of the user exposed.

In the alternative or additionally thereto, in the foregoing embodiment, the entire interior side of the glove along the first section of the base glove portion is configured to be in contact with the palm of the hand of the user.

In the alternative or additionally thereto, in the foregoing embodiment, a first distance between the outer end of the first glove portion and the tip of the index finger defines a first exposed portion of the index finger and a second distance between the outer end of the second glove portion and the tip of the thumb defines a second exposed portion of the thumb.

In the alternative or additionally thereto, in the foregoing embodiment, one or more of the first glove portion, the second glove portion, and the base glove portion include a seam.

In the alternative or additionally thereto, in the foregoing embodiment, the base glove portion has a first side connected to the inner end of the first glove portion and a second side opposite the first side. The glove has a length defined between the outer end of the first glove portion and the second side of the base glove portion and a width defined between the interior side of the glove and a distal point of the outer end of the second glove portion with respect to the interior side of the glove. A ratio of the length to the width is in a first range between 1.00 and 1.70.

In the alternative or additionally thereto, in the foregoing embodiment, the ratio of the length to the width is in a second range between 1.30 and 1.50.

In the alternative or additionally thereto, in the foregoing embodiment, the notch is configured to be in communication with the hand of the user at a junction between the index finger and a middle finger of the user.

In the alternative or additionally thereto, in the foregoing embodiment, the first, second, and base glove portions are made from a single sheet of material.

In the alternative or additionally thereto, in the foregoing embodiment, the sheet is made from leather.

In the alternative or additionally thereto, in the foregoing embodiment, the sheet includes a fold further defining the interior side of the glove along the first glove portion.

According to another embodiment of the present disclosure, a partial-hand glove includes a first glove portion, a second glove portion, and a base glove portion. The first glove portion is configured to surround a portion of only an index finger of a hand of a user. The first glove portion has an outer end and an inner end opposite the outer end. The outer end of the first glove portion is configured to be spaced from a tip of the index finger. The second glove portion is configured to surround a portion of only a thumb of the hand of the user. The second glove portion has an outer end and an inner end opposite the outer end. The outer end of the second glove portion is configured to be spaced from a tip of the thumb. The base glove portion is connected to the respective inner ends of the first glove portion and the second glove portion. The base glove portion includes a first section configured to be disposed against a palm o the hand of the user and a second section configured to be disposed against a back of the hand of the user. The first glove portion and the base glove portion collectively define an interior side of the glove opposite the second glove portion and extending linearly an entire length of the glove. The entire interior side of the glove along the first section of the base glove portion configured to be in contact with the palm of the hand of the user.

In the alternative or additionally thereto, in the foregoing embodiment, the base glove portion is open between the first section and the second section of the base glove portion along the interior side of the glove.

In the alternative or additionally thereto, in the foregoing embodiment, the second section of the base glove portion has a greater area than the first section of the base glove portion.

The present disclosure, and all its aspects, embodiments and advantages associated therewith will become more readily apparent in view of the detailed description provided below, including the accompanying drawings.

DETAILED DESCRIPTION

Figure 1A:
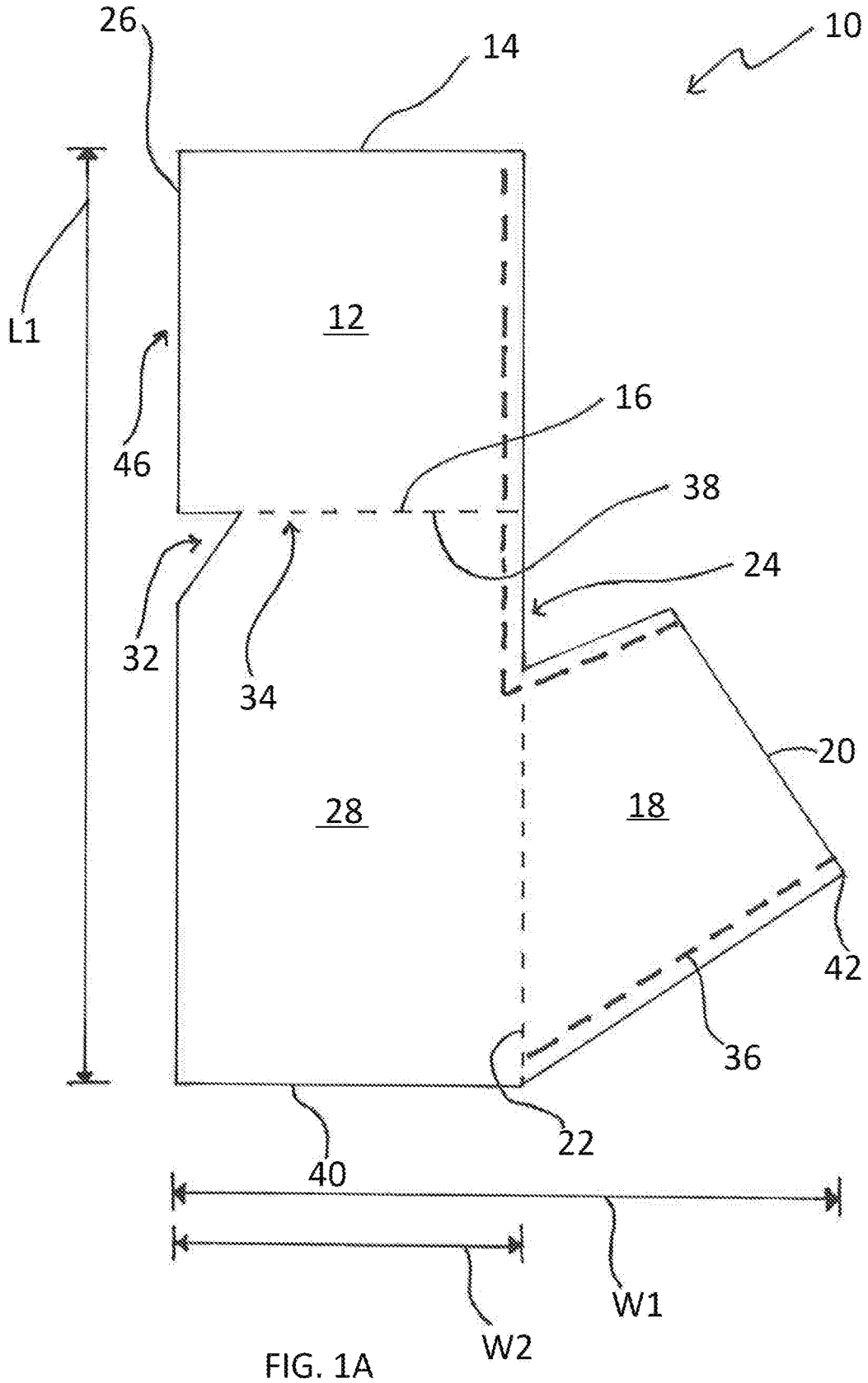
FIG. 1A illustrates a side view of a glove.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

Referring to FIGS. 1A-B and 2A-B, various embodiments of the present disclosure described herein provide a glove 10 configured to be worn over a portion of a user's hand 100. The glove 10 is configured such that portions of the user's hand 100 are protected while conducting various physical activities which will be discussed in further detail. It should be noted that, while the glove 10 may be worn on a user's left hand, right hand, or both the user's left and right hand, the various embodiments of the glove 10 will be shown and described herein with respect to a user's right hand.

The glove 10 generally includes a first glove portion 12, a second glove portion 18, and a base glove portion 24 connected to the first and second glove portions 12, 18. The first glove portion 12 is configured to surround a portion of only an index finger 102 of the hand 100. The first glove portion 12 includes an outer end 14 and an inner end 16 opposite the outer end 14. The second glove portion 18 is configured to surround a portion of only a thumb 108 of the hand 100. The second glove portion 18 includes an outer end 20 and an inner end 22 opposite the outer end 20. The base glove portion 24 is connected to the respective inner ends 16, 22 of the first glove portion 12 and the second glove portion 18. Accordingly, the glove 10 is configured to leave a remainder of the fingers of the user (i.e., the middle, ring, and little fingers) exposed. As used herein, the term "exposed" means that the material of the glove 10 is not intended to envelope the specified portion of the hand 100. Correspondingly, the term "covered" means that the specified portion of the hand 100 is not exposed.

The outer end 14 of the first glove portion 12 may be configured to be spaced from a tip 104 of the index finger 102. A distance D1 between the outer end 14 of the first glove portion 12 and the tip 104 of the index finger 102 may define an exposed portion 106 of the index finger 102. Similarly, the outer end 20 of the second glove portion 18 may be configured to be spaced from a tip 110 of the thumb 108. A distance D2 between the outer end 20 of the second glove portion 18 and the tip 110 of the thumb 108 may define an exposed portion 112 of the thumb 108.

The base glove portion 24 may include a first section 28 configured to be disposed against a palm 116 of the hand 100. The base glove portion 24 may additionally or alternatively include a second section 30 configured to be disposed against a back 118 of the hand 100. As previously noted, the glove 10 may be worn on a user's right or left hand, accordingly, for a glove 10 worn on the left hand, the first section 28 may be disposed against the back 118 of the hand 100 while the second section 30 may be disposed against the palm 116 of the hand 100. The first section 28 of the base glove portion 24 may be configured to cover a portion of the palm 116 of the hand 100. For example, the first section 28 of the base glove portion 24 may be configured to cover one or more of a thenar space, a thenar web space, and/or a junction of the thenar and proximal transverse palmar creases, collectively referred to herein as the thenar space 120. The first section 28 of the base glove portion 24 may additionally be configured to leave a portion of the palm 116 of the hand 100 exposed. For example, the first section 28 of the base glove portion 24 may be configured to leave all or a portion of the palm 116 outside of the thenar space 120 exposed. The base glove portion 24 further includes a first side 38 connected to the inner end 16 of the first glove portion 12 and a second side 40 opposite the first side 38.

Figure 2A:
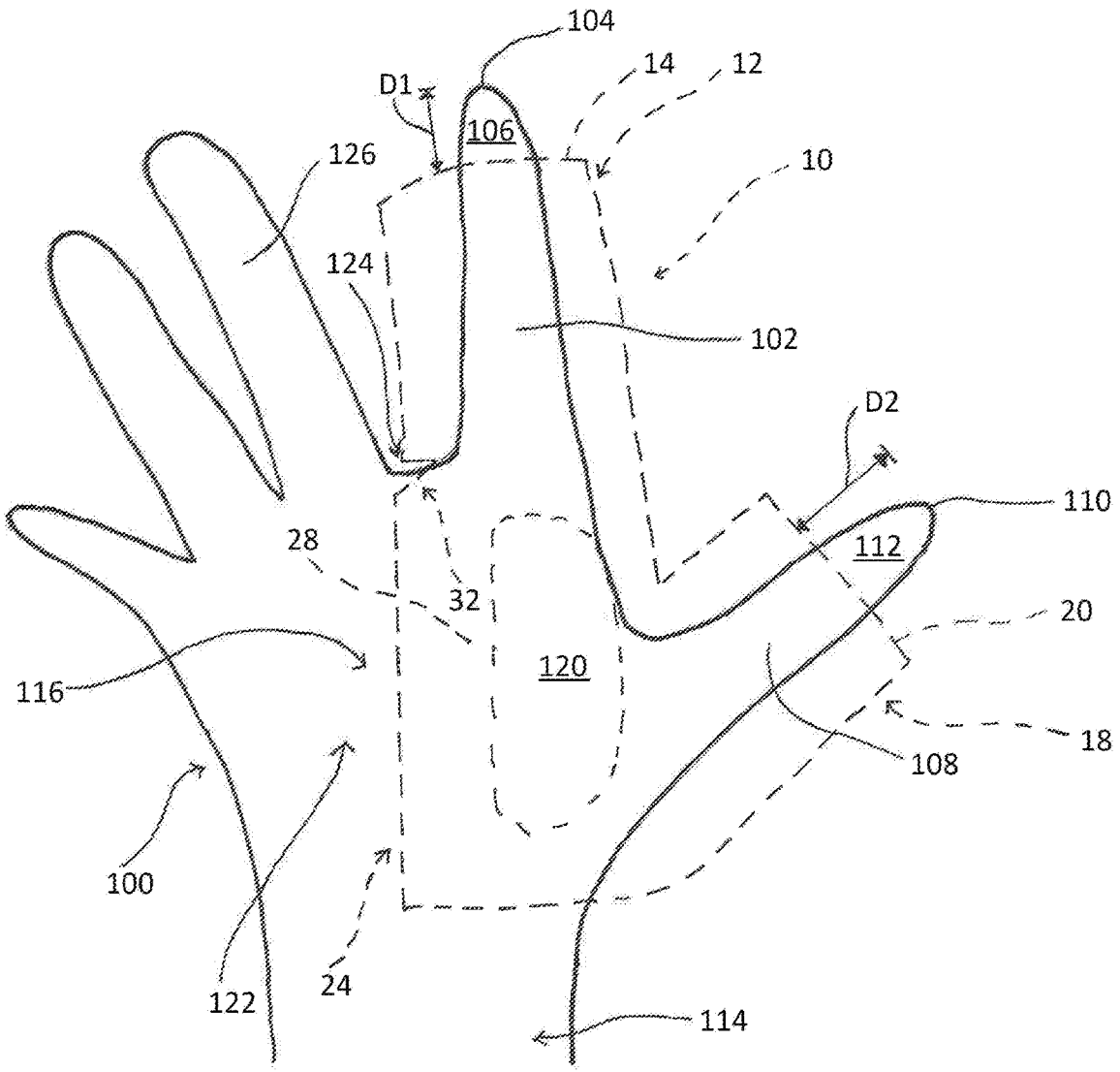
FIG. 2A illustrates a cross-sectional side view of the glove of FIG. 1A worn on a hand of a user.

The first glove portion 12 and the base glove portion 24 may collectively define an interior side 26 of the glove 10 opposite the second glove portion 18. The interior side 26 of the glove 10 may be substantially linear along an entire length L1 of the glove 10 defined between the outer end 14 of the first glove portion 12 and the second side 40 of the base glove portion 24. The base glove portion 24 may be open between the first section 28 and the second section 30 along the interior side 26 and the second side 40 of the glove 10. In other words, the first section 28 and the second section 30 may not be connected to one another along one or both of the interior side 26 and the second side 40. The hand 100 of the user may be disposed between the first section 28 and the second section 30 with the interior side 26 of the glove 10 configured to bisect the palm 116 as shown in FIG. 2A (i.e., to divide the palm into covered and exposed portions which may or may not be of equal size). Accordingly, the entire interior side 26 of the glove 10 along the first section 28 of the base glove portion 24 may be configured to be in contact with the palm 116.

Figure 2B:
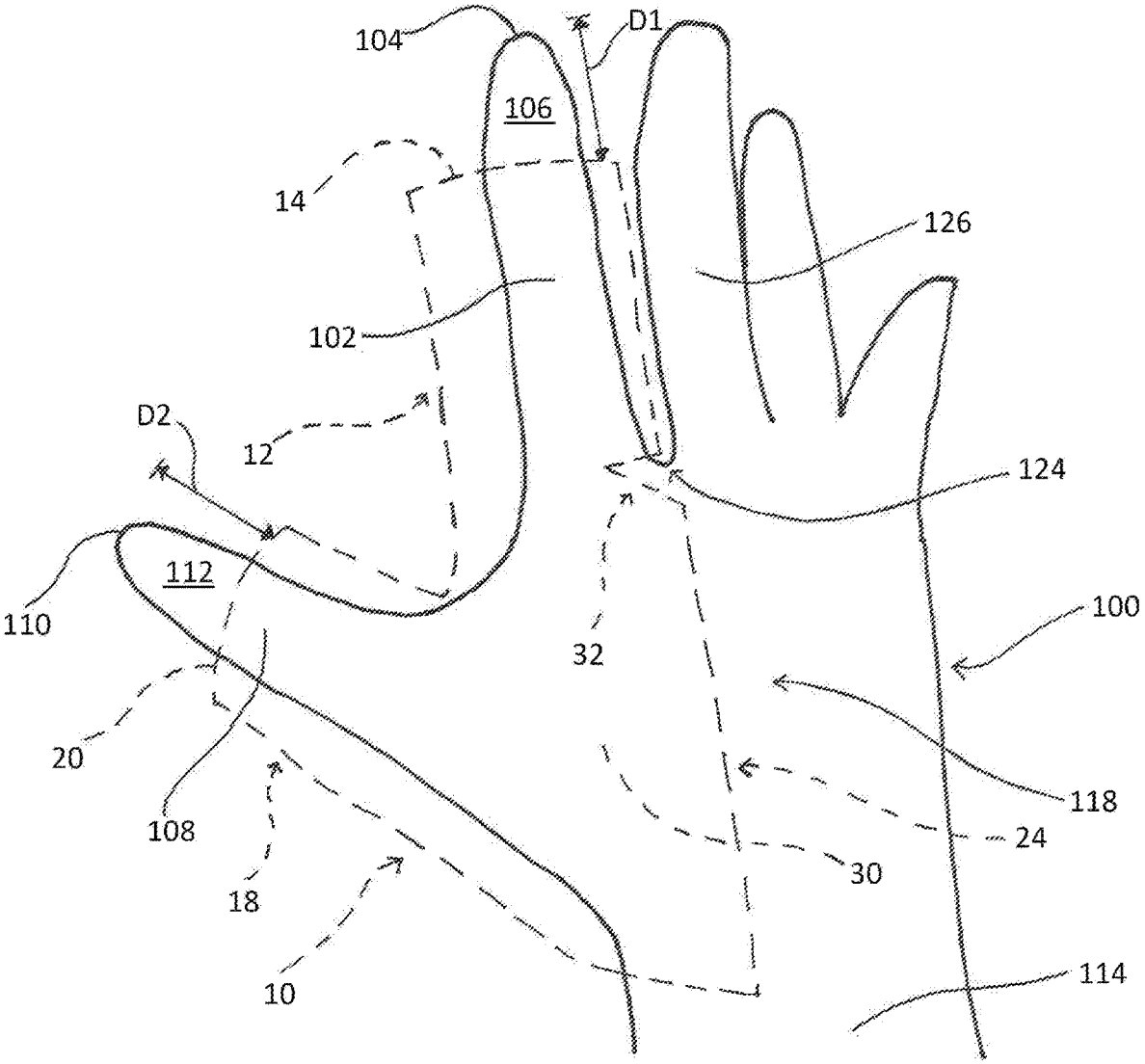
FIG. 2B illustrates another cross-sectional side view of the glove of FIG. 1A worn on the hand of the user.

The base glove portion 24 may be configured to be disposed between the first glove portion 12 and a wrist 114 of the user. In various embodiments, the glove 10 may be configured to leave the wrist 114 of the user exposed. In various embodiments, as shown in FIGS. 2A and 2B, the glove 10 is configured to be independent of (e.g., not fixed to) the wrist 114 of the user, for example, by a wrist band or other coupling mechanism.

In various embodiments, the glove 10 may include a notch 32 disposed in the interior side 26 to improve a fit of the glove 10 on the user's hand 100. For example, the base glove portion 24 may include the notch 32 disposed in the interior side 26 of the glove 10 at an interface 34 between the first glove portion 12 and the base glove portion 24. In various embodiments, the notch 32 may be configured to be in communication with the hand 100 of the user at a junction 124 between the index finger 102 and the middle finger 126 of the user.

One or more dimensions, such as length, width, thickness, etc., of the glove portions 12, 18, 24 may be varied, for example, as necessary to allow the glove 10 to fit a particular hand 100 size or to provide sufficient hand 100 protection or finger dexterity. For non-limiting example, in various embodiments, a length L2 of the first glove portion 12 may be between about 0.50 inches and about 3.00 inches or between about 1.00 inch and about 2.00 inches. For further non-limiting example, in various embodiments, an outer length L3 and an inner length L4 of the second glove portion 18 may be between about 0.50 inches and about 2.00 inches and between about 0.50 inches and about 3.00 inches, respectively, or between about 0.75 inches and about 1.50 inches and between about 1.50 inches and 2.50 inches, respectively. The glove 10 includes a width W1 defined between the interior side 26 of the glove 10 and a distal point 42 of the outer end 20 of the second glove portion 18 with respect to the interior side 26 of the glove 10. In various embodiments, a ratio of the length L1 of the glove 10 to the width W1 of the glove 10 may be between about 1.00 and 1.70. In various other embodiments, a ratio of the length L1 of the glove 10 to the width W1 of the glove 10 may be between about 1.30 and 1.50. In various other embodiments, a ratio of the length L1 of the glove 10 to the width W1 of the glove 10 may be between about 1.40 and about 1.45. One or both of the first glove portion 12 and the base glove portion 24 has a width W2. For non-limiting example, in various embodiments, the width W2 may be between about 1.00 inch to about 4.00 inches or between about 2.00 inches to 2.50 inches. As used herein, the term "about" refers to the specified value +/−5 percent.

Figure 1B:
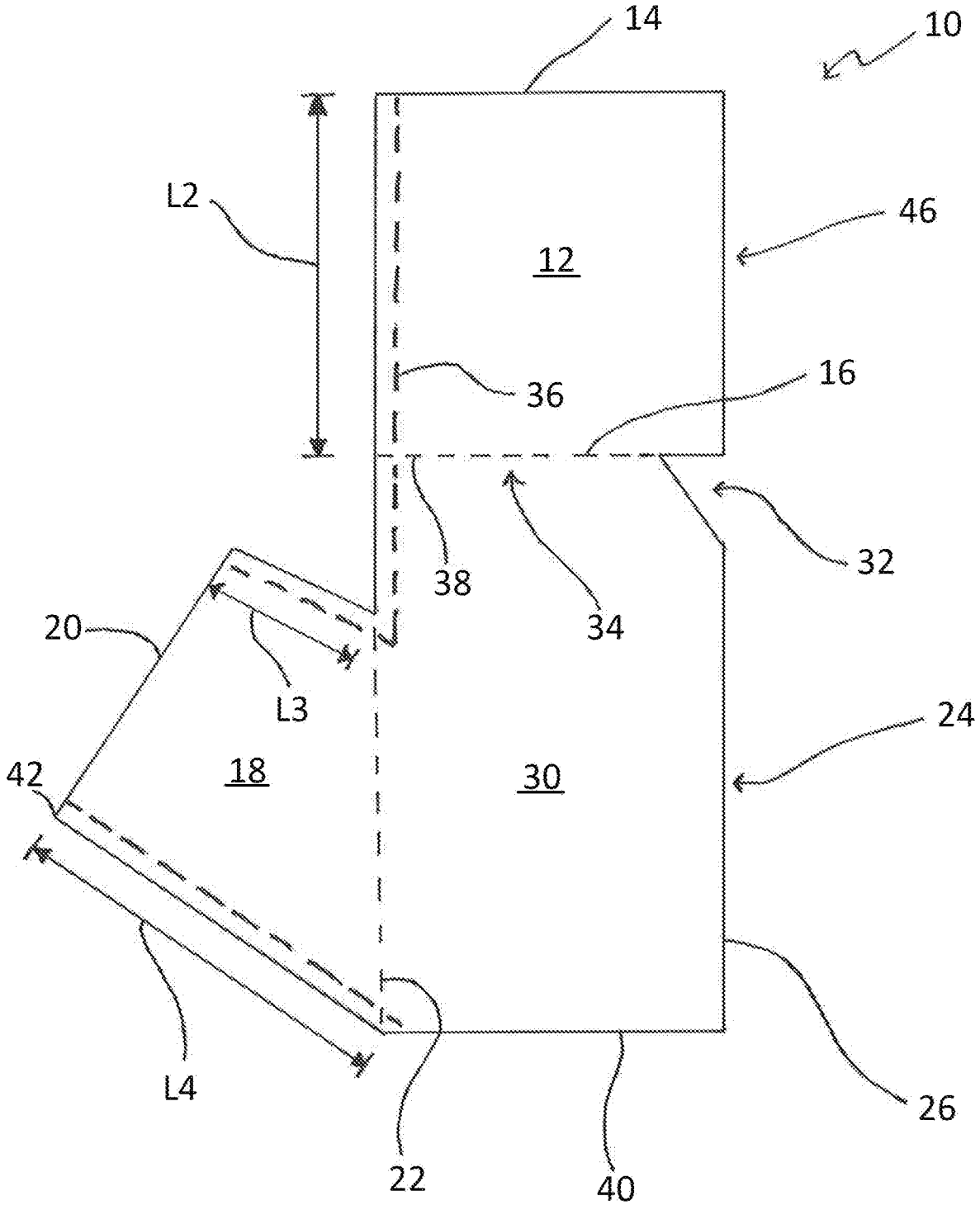
FIG. 1B illustrates another side view of the glove of FIG. 1A.
Figure 1C:
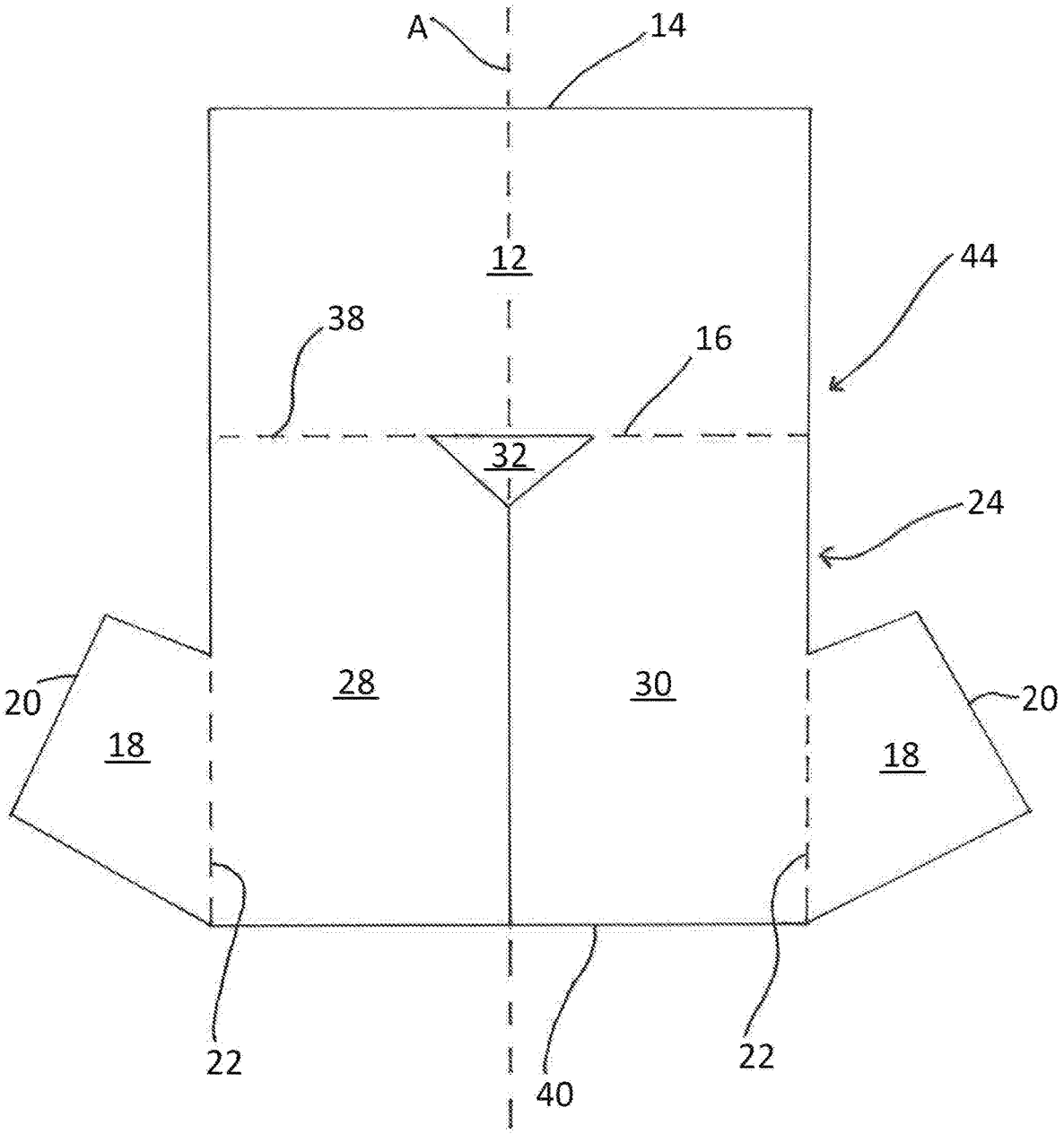
FIG. 1C illustrates a view of the glove of FIG. 1A in an unassembled condition.

Referring to FIGS. 1A-C, the first, second, and third glove portions 12, 18, 24 may be made from a single, continuous sheet 44 of material. The sheet 44 may be folded substantially along an axis A to form a fold 46. The fold 46 may define the interior side 26 of the glove 10 along the length L2 of the first glove portion 12. One or more of the first glove portion 12, the second glove portion 18, and the base glove portion 24 may include a seam 36. The seam 36 may include any suitable material configured to attach a palm side of one or more of the first glove portion 12, the second glove portion 18, and the base glove portion 24 to a respective back side of the first glove portion 12, the second glove portion 18, and the base glove portion 24. For example, the seam 36 may include thread, wire, adhesive, hook-and-loop style fasteners, fasteners such as rivets, buttons, or zippers, etc. The sheet 44 may be made from one or more materials such as leather, cloth, plastic, rubber, etc. configured to provide suitable dexterity and protection of the hand 100.

Figure 3:
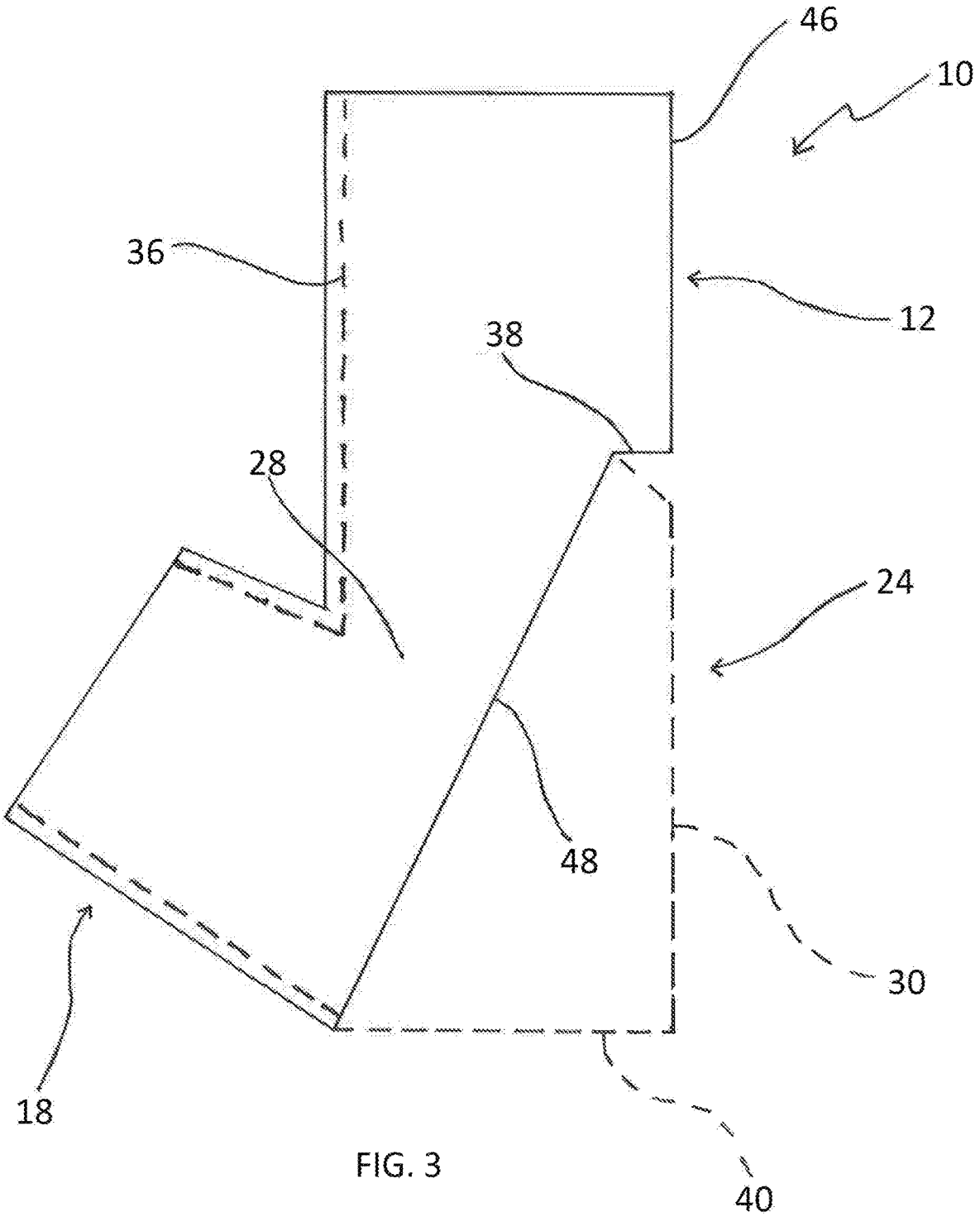
FIG. 3 illustrates a side view of a glove.

Referring to FIG. 3, in various embodiments, the first section 28 of the base glove portion 24 may have a different area (e.g., cross-sectional area) than the second section 30 of the base glove portion 24. For example, as shown in FIG. 3, the second section 30 of the base glove portion 24 may have a greater area than the first section 28 of the base glove portion 24. In various embodiments, one or both of the first section 28 and the second section 30 may include a tapered edge 48 extending between the first side 38 and the second side 40 of the base glove portion 24. The tapered edge 48 may provide an improved fit with respect to the hand 100 of the user. In various embodiments, the tapered edge 48 may be curved along at least a portion of its extend between the first side 38 and the second side 40 of the base glove portion 24 to provide an improved fit with respect to the hand 100 of the user, for example, to fit around a knuckle of the hand 100 of the user.

The glove 10 may be worn to provide protection for portions of the hand 100 (e.g., the thenar space 120) susceptible to physical injury resulting from friction, heat, abrasion, etc. while minimizing unnecessary envelopment of the hand 100. For example, the glove 10 may be used to protect the hand during one or more activities in a non-exhaustive list of activities including yard work related activities such as raking, digging, clipping, chopping, and lawn mowing, industrial activities such as sanding, hammering, and operating hand-held power tools, house work related activities such as vacuuming, mopping, painting, sweeping, and dog walking, and cooking activities such as jar opening and using cookie cutters, etc. The glove 10 may provide protection to the hand 100 during various physical activities requiring use of one or both hands of a user while also providing suitable dexterity for use of the index finger 102 and thumb 108, reduced weight, breathability inside the glove 10 and on the exposed portion of the user's palm 116 to reduce sweating and improve the user's grip, while also allowing the glove 10 to be quickly donned and doffed during use. Further, formation of the glove 10 using a single sheet 44 of material may provide for simplified and lower cost manufacturing of the glove 10.

Systems and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. After reading the description, it will be apparent to one skilled in the relevant art(s) how to implement the disclosure in alternative embodiments. Accordingly, the present disclosure is not to be restricted except in light of the attached claims and their equivalents.

What is claimed is:

1. A partial-hand glove comprising:

a first glove portion configured to surround a portion of only an index finger of a hand of a user, the first glove portion having an outer end and an inner end opposite the outer end, the outer end of the first glove portion configured to be spaced from a tip of the index finger;

a second glove portion configured to surround a portion of only a thumb of the hand of the user, the second glove portion having an outer end and an inner end opposite the outer end, the outer end of the second glove portion configured to be spaced from a tip of the thumb; and a base glove portion connected to the respective inner ends of the first glove portion and the second glove portion, the base glove portion extending between a first side connected to the inner end of the first glove portion and a second side opposite the first side, the second side of the base glove portion defining a terminal end of the glove;

wherein the first glove portion and the base glove portion collectively define an interior side of the glove opposite the second glove portion; and wherein the base glove portion includes a first section configured to be disposed against a palm of the hand of the user and a second section configured to be disposed against a back of the hand of the user, each of the first section and the second section bounded in part by the first side, the second side, the interior side, and the second glove portion, wherein the first section and the second section of the base glove portion are not connected to one another along the second side and a portion of the interior side extending from the second side to the first side.

2. The glove of claim 1, wherein the base glove portion is configured to be disposed between the first glove portion and a wrist of the user.

3. The glove of claim 1, wherein the second section of the base glove portion has a greater area than the first section of the base glove portion.

4. The glove of claim 1, wherein the base glove portion includes a notch disposed in the interior side of the glove at an interface between the first glove portion and the base glove portion.

5. The glove of claim 4, wherein the notch is configured to be in communication with the hand of the user at a junction between the index finger and a middle finger of the user.

6. The glove of claim 1, wherein the first section of the base glove portion is configured to cover a thenar space of the hand of the user.

7. The glove of claim 6, wherein the first section of the base glove portion is configured to leave a portion of the palm of the hand of the user exposed.

8. The glove of claim 7, wherein the entire interior side of the glove along the first section of the base glove portion is configured to be in contact with the palm of the hand of the user.

9. The glove of claim 1, wherein the first glove portion is configured to define a first distance between the outer end of the first glove portion and the tip of the index finger so as to defines a first exposed portion of the index finger and wherein the second glove portion is configured to define a second distance between the outer end of the second glove portion and the tip of the thumb so as to defines a second exposed portion of the thumb.

10. The glove of claim 1, wherein one or more of the first glove portion, the second glove portion, and the base glove portion include a seam.

11. The glove of claim 1, wherein the base glove portion has a first side connected to the inner end of the first glove portion and a second side opposite the first side, wherein the glove has a length defined between the outer end of the first glove portion and the second side of the base glove portion and a width defined between the interior side of the glove and a distal point of the outer end of the second glove portion with respect to the interior side of the glove, and wherein a ratio of the length to the width is in a first range between 1.30 and 1.50.

12. The glove of claim 11, wherein the ratio of the length to the width is in a second range between 1.40 and 1.45.

13. The glove of claim 1, wherein the first, second, and base glove portions are made from a single sheet of material.

14. The glove of claim 13, wherein the sheet is made from leather.

15. The glove of claim 13, wherein the sheet comprises a fold further defining the interior side of the glove along the first glove portion.

16. A partial-hand glove comprising:

a first glove portion configured to surround a portion of only an index finger of a hand of a user, the first glove portion having an outer end and an inner end opposite the outer end, the outer end of the first glove portion configured to be spaced from a tip of the index finger;

a second glove portion configured to surround a portion of only a thumb of the hand of the user, the second glove portion having an outer end and an inner end opposite the outer end, the outer end of the second glove portion configured to be spaced from a tip of the thumb; and a base glove portion connected to the respective inner ends of the first glove portion and the second glove portion, the base glove portion including a first section configured to be disposed against a palm of the hand of the user and a second section configured to be disposed against a back of the hand of the user and the base glove portion extending between a first side connected to the inner end of the first glove portion and a second side opposite the first side, the second side of the base glove portion defining a terminal end of the glove;

wherein the first glove portion and the base glove portion collectively define an interior side of the glove opposite the second glove portion and extending linearly an entire length of the glove, the entire interior side of the glove along the first section of the base glove portion configured to be in contact with the palm of the hand of the user; and wherein each of the first section and the second section bounded in part by the first side, the second side, the interior side, and the second glove portion, wherein the first section and the second section of the base glove portion are not connected to one another along the second side and a portion of the interior side extending from the second side to the first side.

17. The glove of claim 16, wherein the second section of the base glove portion has a greater area than the first section of the base glove portion.

18. A partial-hand glove comprising:

a first glove portion configured to surround a portion of only an index finger of a hand of a user, the first glove portion having an outer end and an inner end opposite the outer end, the outer end of the first glove portion configured to be spaced from a tip of the index finger;

a second glove portion configured to surround a portion of only a thumb of the hand of the user, the second glove portion having an outer end and an inner end opposite the outer end, the outer end of the second glove portion configured to be spaced from a tip of the thumb; and a base glove portion connected to the respective inner ends of the first glove portion and the second glove portion, the base glove portion extending between a first side connected to the inner end of the first glove portion and a second side opposite the first side, the second side of the base glove portion defining a terminal end of the glove;

wherein the first glove portion and the base glove portion collectively define an interior side of the glove opposite the second glove portion; and wherein the base glove portion is configured to be disposed between the first glove portion and a wrist of the user such that the glove is configured to leave the wrist of the user exposed and to be independent of the wrist of the user.

* * * * *